United States Patent [19]

Chuang

[11] Patent Number: 4,878,550

[45] Date of Patent: Nov. 7, 1989

[54] PILOT-VALVE-CONTROLLED PERCUSSION DRILLING TOOL

[75] Inventor: Jo-Yu Chuang, Sugarland, Tex.

[73] Assignee: Sandvik Rock Tools, Inc., Bristol, Va.

[21] Appl. No.: 219,394

[22] Filed: Jul. 15, 1988

[51] Int. Cl.[4] ..... F21B 4/14; F01L 15/00

[52] U.S. Cl. ..... 175/296; 91/50; 91/218; 173/78; 173/134

[58] Field of Search ..... 175/92, 293, 296; 173/73, 78, 116, 134; 91/50, 218

[56] References Cited

U.S. PATENT DOCUMENTS

| | | | |
|---|---|---|---|
| 3,223,182 | 12/1965 | Mikiya | 173/114 |
| 3,332,504 | 7/1967 | Lowery | 173/162 |
| 3,344,868 | 10/1967 | Mikiya et al. | 173/114 |
| 3,411,592 | 11/1968 | Mantabert | 173/134 |
| 4,172,411 | 10/1979 | Matsuda et al. | 91/278 |
| 4,179,983 | 12/1979 | Wallace | 91/394 X |
| 4,660,658 | 4/1987 | Gustafsson | 175/296 |

FOREIGN PATENT DOCUMENTS

| | | | |
|---|---|---|---|
| 2108594 | 5/1983 | United Kingdom | 91/218 |

*Primary Examiner*—Stephen J. Novosad
*Assistant Examiner*—David J. Bagnell
*Attorney, Agent, or Firm*—Burns, Doane, Swecker & Mathias

[57] ABSTRACT

A down-hole percussion drilling tool supplied with compressed air includes a piston reciprocated in an enclosed cylinder against a bit. A spool is continuously reciprocated in a valve chamber by a pilot fluid pressure supply, tapped from the compressed air from a major air flow passage to either a first or a second feed passage. Compressed air conducted through the first feed passage accelerates the piston toward the bit and compressed air conducted through the second feed passage accelerates the piston away from the bit. The continuous reciprocation of the spool is independent of the position of the piston relative to the cylinder.

24 Claims, 5 Drawing Sheets

PILOT-VALVE-CONTROLLED PERCUSSION DRILLING TOOL

TECHNICAL FIELD

The subject invention relates to a downhole drilling tool supplied with a pressurized fluid flow for producing a percussive effect to increase the drilling rate.

BACKGROUND ART

When drilling into hard earth, such as rock, it is necessary to produce an impact force at the penetrating end of the drilling tool in order to crush the rock for increasing the boring rate. Typically, a pressurized fluid, such as compressed air, is used as the energy source in creating the impact force. As will be appreciated, the greater the fluid pressure, the greater the rate of boring. However, with an increase in fluid pressure also comes an increase in the cost of pressurizing the fluid, which can be substantial for large drilling operations.

The prior art percussion drilling tools can be categorized in two general classes. The first class is a high-efficiency type which is characterized by efficient consumption of the pressurized fluid supplied to produce the percussive effects. The high-efficiency type drillling tools, however, operate only with relatively low fluid pressure input due to the inherent structurally weak piston designs associated therewith. The pistons of the high-efficiency type drilling tools are structurally weak because they necessarily include a network of internal flow passages for conducting the pressurized fluid between both ends of the piston depending on the position of the piston in the cylinder. That is, the pistons themselves act as a control valve alternately conducting the pressurized fluid between opposite ends of the piston depending on the position of the piston relative to the cylinder, thereby forcing the piston to move in either direction. Therefore, the high-efficiency type perrcussion drilling tools are ineffective for high-rate drilling, i.e., high-pressure fluid supply, due to their inherently weak piston structures.

The second class of percussion drilling tools is the high-operating pressure type. The high-operating pressure type characteristically provide high-rate drilling due to their structurally sound piston designs, and thus their capability to utilize high pressure fluid. That is, the high-operating pressure type pistons do not include a network of internal flow passages extending therethrough as do the high-efficiency type pistons. However, the high-operating pressure type percussion drilling tools are inherently inefficient in their consumption of pressured fluid. Because the pistons of this class, like those of the high-efficiency class, act as their own control valve by controlling the fluid flow with the changing position of the piston within the cylinder, there necessarily results pressure loss during the impact stroke when the pressurized fluid is suddenly conducted to the opposite end of the piston. This pressure loss results in the drilling tools of the high-operating pressure type being deficient for economical high-rate drilling.

The U.S. Pat. No. 3,332,504 to Lowery issued Jul. 25, 1967, discloses an impact tool including a spool-type control valve for alternately conducting a flow of pressurized fluid between opposite ends of a piston. The control valve is reciprocated between two fluid-conducting positions by the same fluid pressure that urges the piston to move. The Lowery impact tool is deficient in that movement of the control valve between its two fluid-conducting positions is dependent upon the position of the piston. That is, while the control valve is in a position for conducting fluid to the upper end of the piston to force the piston toward an impact position, the control valve remains stationary. When the piston is prevented from moving further, i.e., when the piston is in its impact position, the fluid pressure in the cylinder acts upwardly through a small vertical passage to move the control valve upwardly to a position for conducting fluid to the lower end of the piston. This results in a hesitation, or dwell, in the impact cycle as the piston stops, then the control valve moves, then the fluid is redirected to the opposite end of the piston. Therefore, the Lowery impact tool provides a relatively slow impact cycle as the movement, i.e., operation, of the control valve is dependent upon the position of the piston relative to the cylinder.

The U.S. Pat. No. 4,172,411 to Matsuda et al, issued Oct. 30, 1979, discloses a hydraulic hammer including a spool valve for directing hydraulic fluid pressure to either end of a double-acting cylinder depending upon the position of a piston within the cylinder. The Matsuda patent, like the Lowery patent, is deficient in that the piston impact cycle is relatively slow due to the dependency of the spool valve movement upon the piston position.

The U.S. Pat. No. 4,179,983 to Wallace, issued Dec. 25, 1979, discloses a hydraulic hammer including a spool valve for directly hydraulic fluid pressure to a piston. The spool valve moves between two fluid directing positions in response to the position of the piston within its cylinder. The Wallace patent, like the Lowery and Matsuda patents, is deficient in that the piston impact cycle is relatively slow due to the dependency of the spool valve movement upon the piston position.

It will be appreciated from the foregoing description of the prior art that there exists a need in the percussion drilling tool art for a drilling tool which efficiently uses pressurized fluid, is structurally capable of high-rate drilling supplied by high-pressure fluid, and is capable of relatively rapid impact cycles.

SUMMARY OF THE INVENTION AND ADVANTAGES

The present invention relates to a down-hole drilling tool of the type for boring into the earth and supplied with a pressurized fluid flow to operate the tool for increased boring rate. The drilling tool comprises impact piston means moved by the fluid flow toward and away from an impact position for producing an impact force, conduit means for conducting the fluid flow to the impact piston means, and control valve means in the conduit means for controlling fluid flow to the impact piston means. At least a portion of the control valve means is movable between a first position for directing the fluid flow in the conduit means to move the impact piston means toward the impact position, and a second position for directing the fluid flow in the conduit means to move the impact piston means away from the impact position. The control valve means is responsive to fluid flow in the conduit means for continuously cycling between the first and second positions. The drilling tool of the subject invention is characterized by the control valve means continuously cycling between the first and second positions independently of the position of the impact piston means.

The subject invention overcomes the deficiencies in the prior art by providing control valve means which directs the fluid flow to the impact means independently of the position of the impact means. Therefore, pressurized fluid is efficiently utilized by eliminating excessive pressure losses during sudden redirection of the fluid flow to the impact means. Additionally, the impact means is structurally designed to withstand severe impact forces due to the elimination of a requirement for the impact means to control its own fluid flow direction. Further, because the control valve means operates independently of the position of the impact means, there are no periods of hesitation in the cycle.

BRIEF DESCRIPTION OF THE DRAWING

Other advantages of the present invention will be readily appreciated as the same becomes better understood by reference to the following detail description when considered in connection with the accompanying drawings wherein.

DETAILED DESCRIPTION OF THE PREFERRED EMBODIMENT

Figure 1:
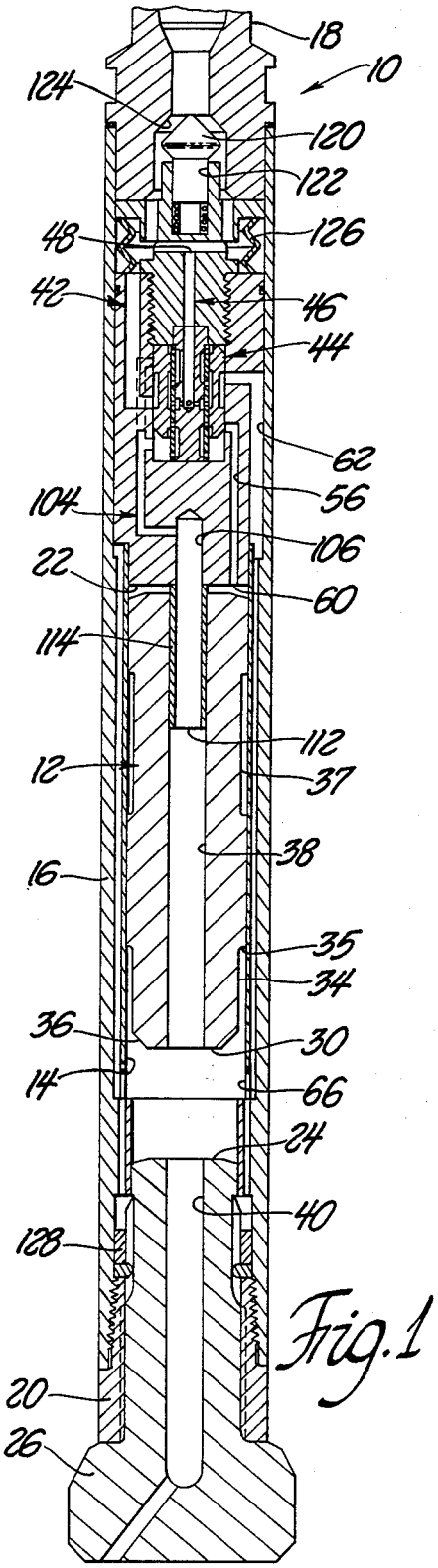
FIG. 1 is a cross-sectional view of the subject invention showing the control valve means in the second position.
Figure 2:
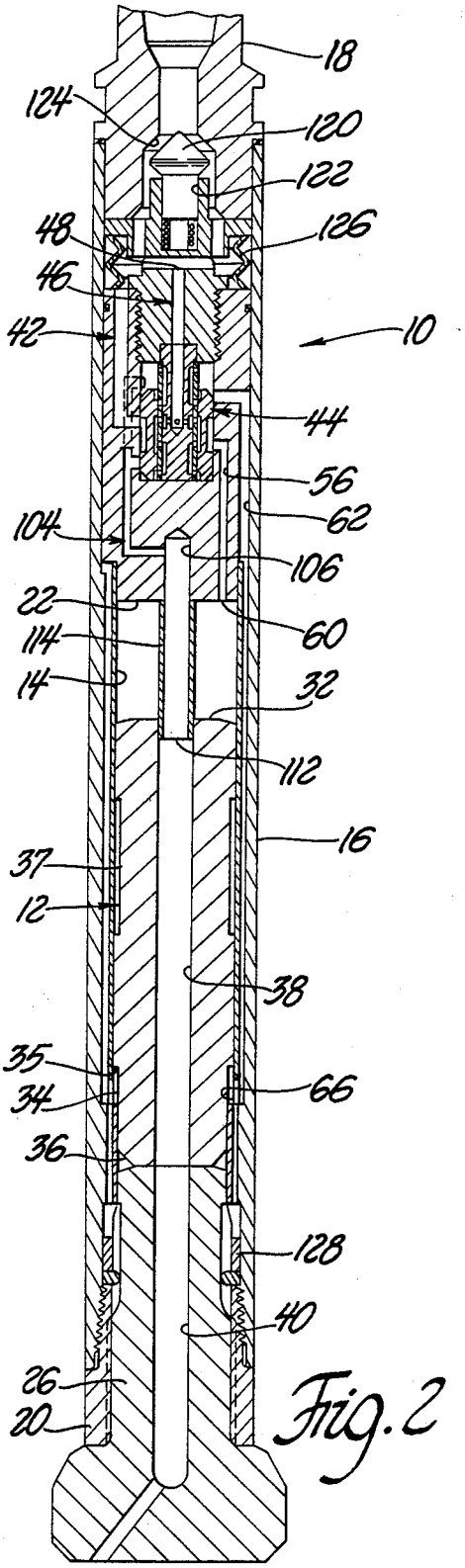
FIG. 2 is a cross-sectional view of the subject invention showing the control valve means in the first position and the impact means in the impact position.

Referring to FIGS. 1 and 2, wherein like numerals indicate like or corresponding parts throughout the several views, a percussion drilling tool according to the subject invention is generally shown at 10. The drilling tool 10 is of the type for boring into the earth during such operations as mining, quarrying, water-well drilling, and the like. Because the earth to be drilled is often composed of rock or other such materials into which it is difficult to bore, the subject drilling tool 10 is supplied with a pressurized fluid flow to produce a repetitious percussive effect for increasing the boring rate. Although other fluids may be used, the ensuing description of the preferred embodiment will make reference to the pressurized fluid as compressed air.

The subject drilling tool 10 provides an impact piston, generally indicated at 12 in FIGS. 1 and 2, which is rapidly moved by the fluid flow toward and away from an impact position for producing a repetitious impact force. The impact piston 12 is shown in the impact position in FIG. 2. The impact piston 12 moves within a cylinder 14. The cylinder 14 is encased within an elongated tubular jacket 16. A top sub 18 is fixedly positioned in the upper end of the jacket 16 and a driver sub 20 is threaded in the lower penetrating end of the jacket 16. The interior of the cylinder 14 has a top end 22 and an axially spaced anvil surface 24 which forms the impacting surface of a bit 26. The bit 26 is coupled to the driver sub 20 by a spline-type connection.

The piston 12 is reciprocated along its longitudinal axis within the cylinder 14 toward and away from the impact position. That is to say, the piston 12 is moved in the cylinder 14 by the fluid flow against and away from the anvil surface 24. The piston 12 is a body of revolution having an impacting end 30 adjacent the anvil surface 24 and a nonimpacting end 32 adjacent the top end 22. For reasons which will be described subsequently, the piston 12 has a reduced diameter nose portion 34 extending a short axial length adjacent the impacting end 30. An annular shoulder 35 extends between the nose 34 and the outer surface of the piston 12. A chamfer 36 is provided around the circumference of the impacting end 30 of the piston 12. A reduced diameter waist portion 37 is provided about the midportion of the piston 12. A bore 38 extends axially through the piston 12 in axial alignment with a bore 40 extending axially through the bit 26. The bore 40 in the bit 26 is in communication with the ambient atmosphere about the drilling tool 10.

The subject drilling tool 10 also provides a conduit network, generally indicated at 42, for conducting the fluid flow to the impact piston 12. A control valve, generally indicated at 44, is disposed in the conduit network 42 for controlling the fluid flow to the impact piston 12. The control valve means 44 includes at least a portion defined by a spool 45 which is movable between a first position foir directing the fluid flow in the conduit network 42 to move the piston 12 toward the impact position, and a second position for directing the fluid flow in the conduit network 42 to move the piston 12 away from the impact position. In FIG. 1, the spool 45 is shown in the second position, whereas in FIG. 2 the spool 45 is shown in the first position. The control valve 44 is responsive to fluid flow in the conduit network 42 for continuously cycling between the first and second positions.

More specifically, the conduit network 42 includes a pilot passage, generally indicated at 46, for continuously conveying pilot fluid pressure from a tap 48 in the fluid flow in the conduit network 42 to the control valve 44. The spool 45 is responsive to the pilot fluid pressure from the pilot passage 46 for continuously cycling between the first and second positions independently of the fluid flow in the conduit network 42 after the tap 48.

Figure 4:
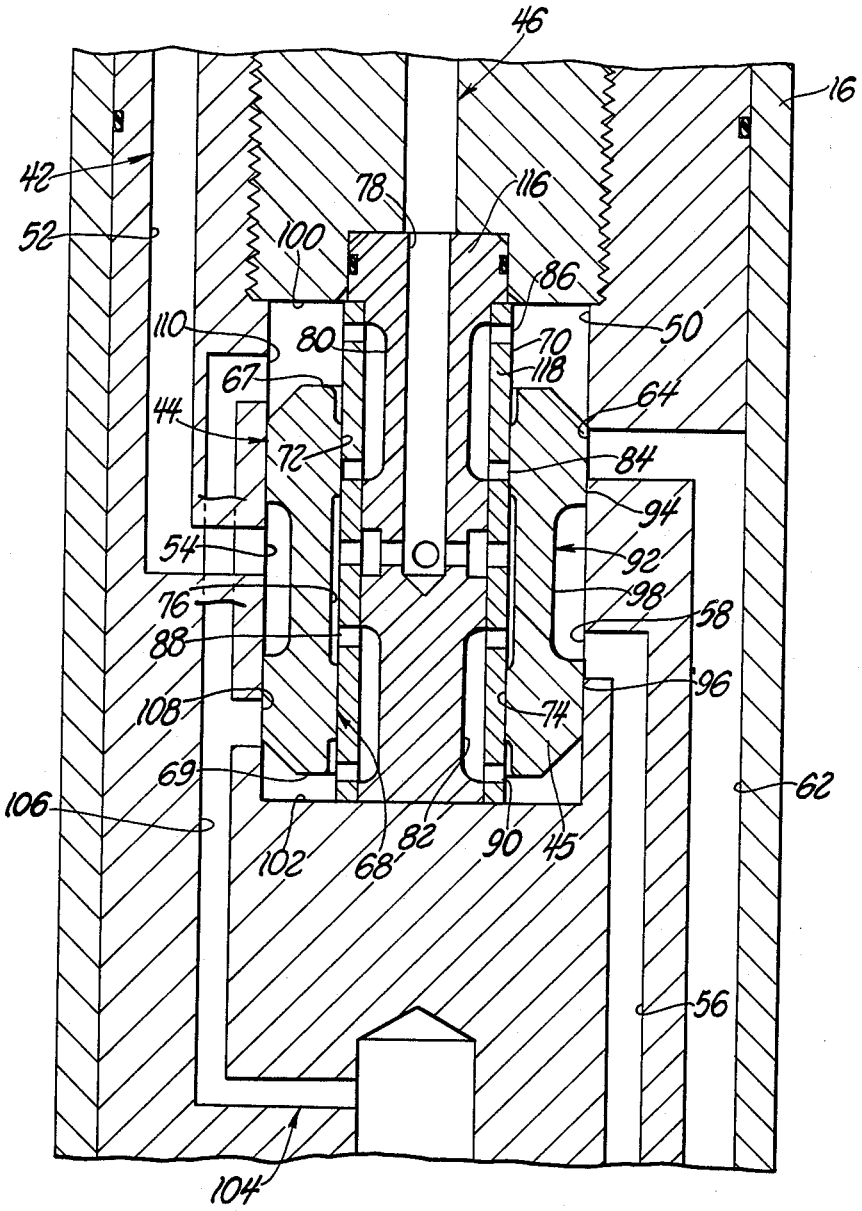
FIG. 4 is an enlarged cross-sectionalf view of the control valve means shown moving out of or into the first position.

The control valve 44 is disposed within a valve chamber 50 (as shown in FIG. 4) of the conduit network 42. The valve chamber 50 is defined by the internal circumferential surface of a cylindrical wall and is disposed in the conduit network 42 after the tap 48. Pilot fluid pressure entering the tap 48 travels through the pilot passage 46 and into the valve chamber 50.

The conduit network 42 includes a major flow passage 52 diposed between the tap 48 and the valve chamber 50 for conducting fluid flow to the piston 12. That is, the major flow passage 52 conducts the fluid flow, less the fluid flow tapped into the pilot fluid passage 46, to the piston 12. The major flow passage 52 has an opening 54 into the valve chamber 50. A first feed passage 56 conducts the fluid flow from the valve chamber 50 to move the piston 12 toward the impact position. The first feed passage 56 has an opening 58 in communication with the valve chamber 50 and an exit 60 disposed in the cylinder 14 adjacent the top end 22 for communicating fluid pressure between the valves chamber 50 and the cylinder 14.

The conduit network 42 also includes a second feed passage 62 for conducting fluid flow from the valve chamber 50 to move the piston 12 away from the impact position. The second feed passage 62 has an opening 64 in communication with the valve chamber 50. The second feed passage 62 extends from the opening 64 in the valve chamber 50, between the cylinder 14 and the jacket 16, to an exit 66 disposed in the cylinder 14 adjacent the anvil surface 24 for communicating fluid passage from the valve chamber 50 to the cylinder 14.

The spool 45 of the control valve 44 includes valve lands, generally indicated at 68 in FIGS. 3 through 6, disposed adjacent the pilot passage 46 and responsive to the pilot fluid pressure flowing through the pilot passage 46 for continuously urging the spool 45 to cycle between the first and second positions depending on the position of the spool 45 relative to the first and second positions. That is to say, the position of the spool 45 within the valve chamber 50 governs the air flow direction to either a top end 67 or a bottom end 69 of the spool 45 to move the spool 45 between the first and second positions.

The subject drilling tool 10 is characterized by the spool 45 of the control valve 44 continuously cycling between the first and second positions independently of the position of the piston 12. That is to say, the spool 45 continuously cycles between its first and second positions for directing the fluid flow in the conduit network 42 to move the piston 12 toward and away from the impact position irrespective of the position of the piston 12. The spool 45 is reciprocated along its longitudinal axis between the first and second positions within the valve chamber 50. As shown in FIGS. 1 and 2, the longitudinal axis of the control valve 44 is aligned with the longitudinal axis of the piston 12 and cylinder 14.

The control valve 44 includes a core member, generally indicated at 70, extending axially through the spool 45 and adjacent the valve lands 68 for conducting the pilot fluid pressure to the valve lands 68. The core member 70 is an elongated cylindrical member having a longitudinal axis coincidental with the longitudinal axes of the spool 45 and the valve chamber 50. The core member 70 extends the entire axial length of the valve chamber 50. The spool 45 comprises a body of revolution about its longitudinal axis, as will be appreciated from the fact that the core member 70 and the valve chamber 50 are both cylindrical.

In the preferred embodiment, the core member 70 is comprised of an inner stem 116 and an outer sleeve 118. As best shown in FIGS. 3 through 6, the inner stem 116 is an integral body of revolution about the longitudinal axis of the core member 70 and includes an upper annular groove forming the upper passage 80 and a lower annular groove forming the lower feed passage 82. The tubular sleeve 118 is disposed about the stem 116 in tight fitting engagement. The sleeve 118 includes a plurality of radially extending apertures 84, 86, 88, 90 defining each of the upper feed passage inlet ports 84, the upper feed passage outlet ports 86, the lower feed passage inlet ports 88, and the lower feed passage outlet ports 90. Additionally, radially extending apertures are provided in the sleeve 118 for corresponding with a plurality of outlets for the pilot feed passage 78. By fabricating the core member 70 from the inner stem 116 and the outer sleeve 118, manufacturing costs can be substantially reduced.

The valve lands 68 of the spool 45 include an annular upper land 72, an axially spaced annular lower land 74, and an annular recess 76 between the upper 72 and lower 74 lands. The recess 76 and the upper 72 and lower 74 lands have a continuous axial length about the internal circumference of the spool 45. The upper 72 and lower 74 lands are disposed in fluid-sealing engagement with the core member 70. That is to say, the upper 72 and lower 74 lands are slideable along the exterior surface of the core member 70 while preventing the movement of fluid therepast.

The core member 70 includes a pilot feed passage 78, as shown in FIGS. 3 through 6, having portions extending radially outwardly of the longitudinal axis and in continuous communication with the recess 76 of the valve lands 68. Said another way, the pilot feed passage 78 communicates pilot fluid pressure to the recess 76 continuously while the spool 45 reciprocates in the valve chamber 50. Further, the core member 70 includes an upper feed passage 80 and an axially spaced lower feed passage 82. The upper feed passage 80 includes an inlet port 84 adjacent the pilot feed passage 78 and an axially spaced distal outlet port 86. The lower feed passage 82 includes an inlet port 88 adjacent the pilot feed passage 78 and an axially spaced distal outlet port 90.

Figure 3:
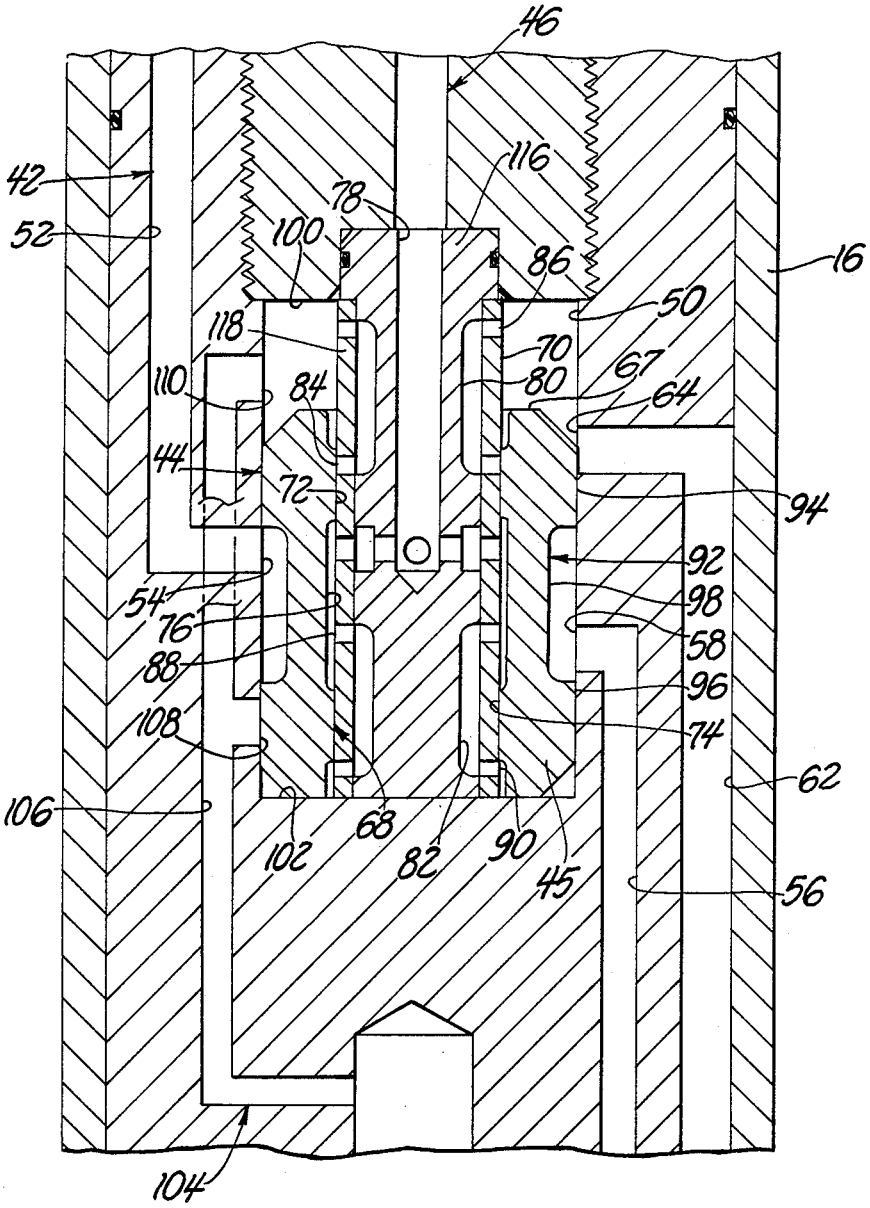
FIG. 3 is an enlarged cross-sectional view of the control valve means shown in the first position.
Figure 6:
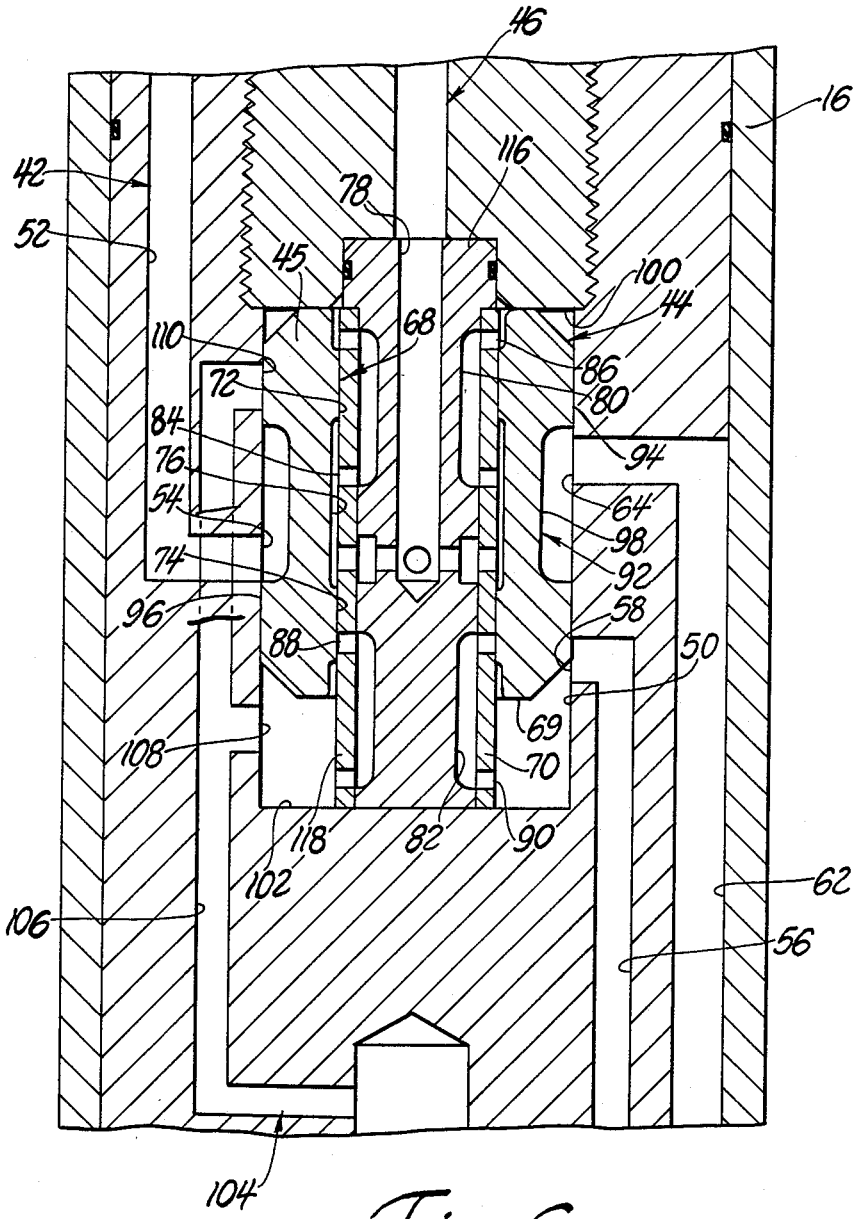
FIG. 6 is an enlarged cross-sectional view of the control valve means shown in the second position.

The axial space between the inlet port 84 of the upper feed passage 80 and the inlet port 88 of the lower feed passage 82 is equal to or greater than the axial length of the recess 76 of the spool 45. In other words, the recess 76 is not long enough to allow communication between the upper 80 and lower 82 feed passages via their respective inlet ports 84, 88 at the same time. Therefore, because the pilot feed passage 78 is continually in communication with the rcess 76 of the spool 45, inlet ports 84, 88 of the upper 80 and lower 82 feed passages alternately communicate with the pilot feed passage 78 as the spool 45 reciprocate between the first and second positions. That is, when the spool 45 is in the first position as shown in FIG. 3, the recess 76 of the spool 45 communicates pilot fluid pressure from the pilot feed passage 78 to the lower feed passage 82 via the inlet port 88, while the upper land 72 closes off the inlet port 84 of the upper feed passage 80. When the spool 45 is in the second position as shown in FIG. 6, the recess 76 communicates the pilot fluid pressure from the pilot feed passage 78 to the upper feed passage 80 via the inlet port 84, while the lower land 74 closes off the inlet port 88 of the lower feed passage 82.

Considering now the reciprocation of the spool 45 within the valve chamber 50, the spool 45 is shown in the first position in FIG. 3. As described above, pilot fluid pressure is directed through the pilot feed passage 78, into the recess 76 on the inner surface of the spool 45, and into the lower feed passage 82 via the inlet port 88. The pilot fluid pressure is then directed out of the lower feed passage 82 through the outlet port 90 and acts against the lower land 74 and the bottom end 69 of the spool 45 to urge the spool 45 to move upwardly in the valve chamber 50 to the position shown in FIG. 4. As will be described subsequently, stagnant fluid above the spool 45 is vented from the valve chamber 50 during spool 45 movement from the first to second position. From the spool 45 position shown in FIG. 4, it will be observed that the lower feed passage 82 remains in communication with the pilot feed passage 78 to continue conducting pilot fluid pressure through the outlet port 90 to further urge the spool 45 upward in the valve chamber 50. As the spooll 45 moves upwardly in the valve chamber 50 to the position shown in FIG. 5, the recess 76 moves out of communication with the lower feed passage 82 and into communication with the upper feed passage 80. Depending upon the pressure and flow rate of the fluid, the upward momentum of the spool 45 may continue to move the spool 45 fully into the second position as shown in FIG. 6. When the pilot fluid pressure is sufficient to overcome the upward momentum, the spool 45 is urged to move back toward the first position in like manner as that described above. As referenced above, the stagnant fluid below the spool 45 is vented from the valve chamber 50 during spool 45 movement from the second to first position. In this manner, the spool 45 is cylindrically reciprocated within the valve chamber 50 by its alternating communication between the upper 80 and lower 82 feed passages, dependent only upon the position of the spool 45 within the valve chamber 50.

The spool 45 includes valve channels, generally indicated at 92 in FIGS. 3 through 6, for conducting the fluid flow from the major flow passage 52 to the first feed passage 56 when the spool 45 is in the first position and conducting the fluid flow from the major flow passage 52 to the second feed passage 62 when the spool 45 is in the second position. The valve channels 92 include an upper lip 94 in fluid sealing engagement with the valve chamber wall 50, an axially spaced lower lip 96 in fluid sealing engagement with the valve chamber wall 50, and a central channel 98 disposed between the upper 94 and lower 96 lips. The central 98 provides a continuous axial length about the periphery of the spool 45. That is, the central channel 98 is a continuous annular channel disposed in the outer surface of the spool 45. The central channel 98 is in continuous communication with the major flow passage 52 and alternating communication between the first 56 and second 62 feed passages as the spool 45 reciprocates in the valve chamber 50.

More specifically, the valve chamber 50 includes a top end 100 and a bottom end 102. The first feed passage opening 58 into the valve chamber 50 is disposed adjacent the bottom end 102 of the valve chamber 50. The second feed passage opening 64 in the valve chamber 50 is disposed adjacent the top end 100 of the valve chamber 50. Said another way, the opening 58 of the first feed passage 56 is axially spaced relative to the opening 64 of the second feed passage 62 and the first feed passage opening 58 is positioned proximate the bottom end 102 of the valve chamber 50 and the second feed passage opening 64 is positioned proximate the top end 100 of the valve chamber 50. The axial space between the openings 58, 64 of the first 56 and second 62 feed passages is equal to or greater than the axial length of the central channel 98. This is to prevent the fluid flow from the major flow passage 52 from simultaneously being conducted to the first feed passage 56 and the second feed passage 62.

Figure 5:
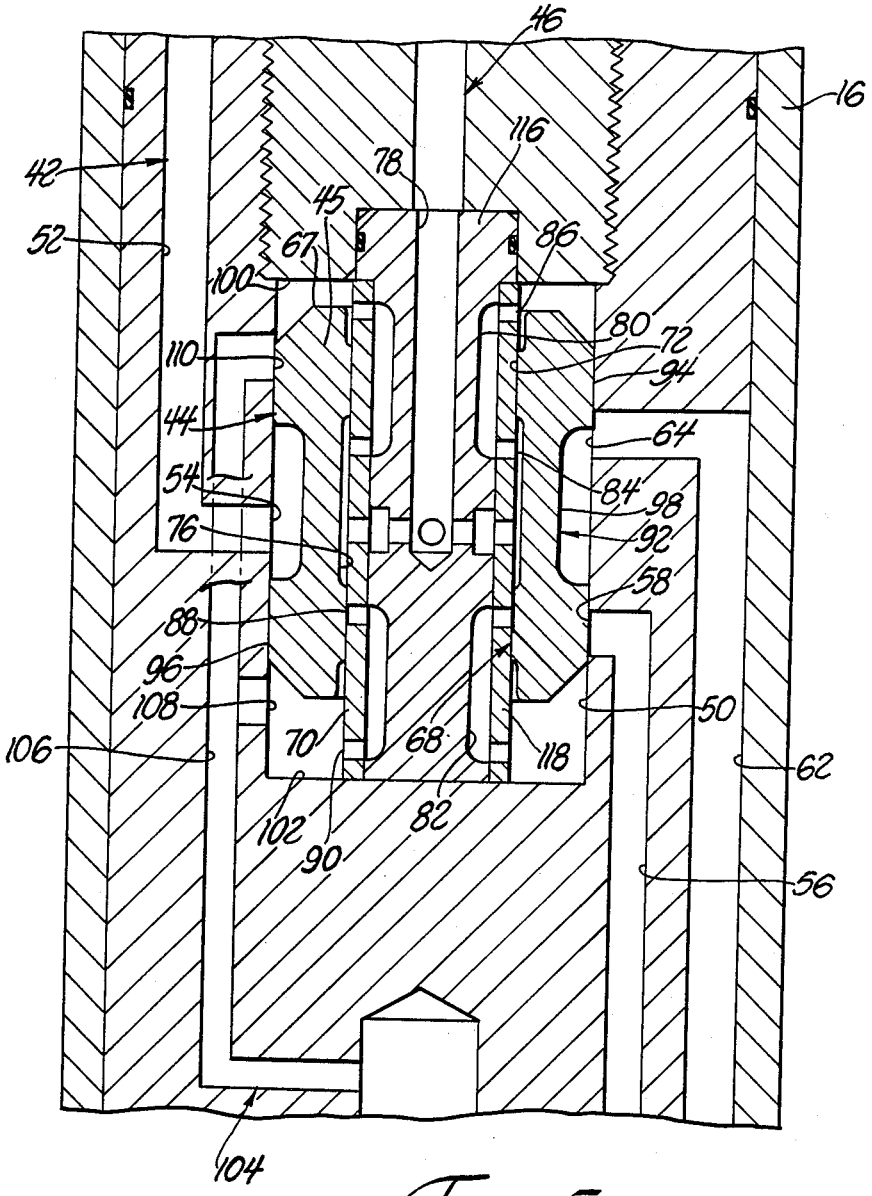
FIG. 5 is an enlarged cross-sectional view of the control valve means shown moving into or out of the second position.

The major flow passage opening 54 is disposed in the valve chamber 50 at an axial spacing centrally of the openings 58, 64 of the first 56 and second 62 feed passages. As will become apparent from reference to FIGS. 3 through 6, the axial length of the central channel 98 is such as to remain in continuous communication with the major flow passage 52 while reciprocating between the first and second positions. More specifically, as the spool 45 is disposed in the first position as shown in FIG. 3, the central channel 98 directs the fluid flow from the major flow passage 52 to the first feed passage 56. As the pilot fluid pressure urges the valve lands 68 and bottom end 69 to move the spool 45 upwardly in the valve chamber 50, as shown in FIG. 4, the lower lip 96 passes over the first feed passage opening 58 and the central channel 98 begins to move out of communication with the first feed passage 56. During the continued upward movement of the spool 45, the central channel 98 moves into communication with the second feed passage 62, thus directing the fluid flow through the major flow passage 52 to the second feed passage 62, as shown in FIG. 5. When the spool 45 is in the second position, as shown in FIG. 6, the central channel 98 conducts the fluid flow from the major flow passage 52 directly to the second feed passage 62. Therefore, the first position of the spool 45 is defined when central channel 98 of the spool 45 is in communication with the first feed passage 56 and the second position of the spool 45 define when the central channel 98 of the spool 45 is in communication with the second feed passage 62.

The conduit network 42 includes vent passages, generally indicated at 104, for conducting fluid out of the drilling tool 10. The vent passages 104 includes a pilot vent passage 106 having a first opening 108 in communication with the valve chamber 50 adjacent the bottom end 102 and a second opening 110 in communication with the valve chamber 50 adjacent the top end 100. The pilot vent passage 106 provides an exhaust for the pilot fluid trapped in the valve chamber 50. The pilot vent passage 106 has an exit opening 112 in communication with the bore 38 extending axiallly through the piston 12. More specifically, a thin-walled vent tube 114 defines a portion of the pilot vent passage 106 which extends into the cylinder 14. The vent tube 114 has an external surface in fluid sealing engagement with the bore 38 of the piston 12. The axial length of the vent tube 114 is longer than the axial stroke distance of the piston 12 so that the vent tube 114 never disengages from the bore 38 in the piston 12 during the impact cycle.

The vent passages 104 also provide for exhaust of the fluid used in moving the piston 12 toward and away from the anvil surface 24. More specifically, as the fluid is conducted through the second feed passage 62 to move the piston 12 away from the anvil surface 24, the volume of fluid located between the nonimpacting end 32 of the piston 12 and the top end 22, exterior of the vent tube 114, is exhausted into the first feed passage exit 60 in reverse direction through the first feed passage 56, into the valve chamber 50, underneath the spool 45 and into the pilot vent passage 106 through the first opening 108. Conversely, as compressed air is fed through the first feed passage 56 to urge the piston 12 toward the anvil surface 24, the volume of fluid between the anvil surface 24 and the impact end 30 is freely expelled through the bore 40 and the bit 26. When the chamfer 36 on the piston 12 has moved past, i.e., closed off, the second feed passage exit 66, the volume of fluid remaining around the reduced diameter nose 34 and the shoulder 35 of the piston 12 is exhausted in reverse direction through the second feed passage 62, into the valve chamber 50, over the spool 45, and into the pilot vent passage 106 via the second opening 110.

A dart valve 120 is shown in FIG. 1 and 2 slidably disposed in a cylindrical pocket 122. The dart valve 120 is spring biased to engage and seal against a valve seat 124 provided in the conduit network 42 in the top sub 18. In response to a predetermined fluid pressure, the dart valve 120 is urged away from the valve seat 124 to allow the fluid to flow past. When the fluid pressure falls below the predetermined level, the dart valve 120 engages the valve seat 124 and prevents water or other such ambient fluid about the drilling tool 10 from entering the drilling tool 10 via the bore 40 in the bit 26.

A compression spring 126 is disposed in the conduit network 42 for exerting a force on the internal structure of the drilling tool 10 for insuring proper alignment of the internal structure during operation of the drilling tool 10.

A description of the movement of the piston away from the anvil surface 24 will now be addressed. When the piston 12 is in the impact position, i.e., in contact with the anvil surface 24, as shown in FIG. 2, the spool 45 is urged toward the second position to convey fluid pressure from the major flow passage 52, through the second feed passage 62, out the second feed passage exit 66 and into the cylinder 14 adjacent the reduced diameter nose 34 of the piston 12. As will be observed from FIGS. 1 and 2, a foot valve 128 adjacent the anvil surface 24 has a reduced diameter for receiving the nose 34 of the piston 12 in fluid-sealing engagement. The fluid pressure acts against the annular shoulder 35 of the piston 12 to urge the piston 12 away from the anvil surface 24. As soon as the chamfer 36 moves across the second feed passage 66, the fluid pressure entering the cylinder 14 ceases to urge the piston 12 away form the anvil surface 24, but flows out through the bore 40 in the bit 26. In this manner, the piston 12 is never forcefully urged against the top end 22 of the cylinder 14, thereby preventing damage to the drilling tool 10 structure above the top end 22. In order words, as the fluid pressure from the second feed passage 62 urges the piston 12 away from the impact position, fluid pressure is momentarily lost when the chamfer 36 on the impacting end 30 of the piston 12 moves into communication with the exit 66 of the second feed passage 62. However, just after the chamfer 36 moves into communication with the second feed passage 66, the spool 45 is urged by the pilot fluid pressure back toward the first position to conduct the fluid flow through the major flow passage 52 to the first feed passage 56 to urge the piston 12 toward the anvil surface 24. In this manner, fluid pressure is never lost while the piston 12 moves toward the impact position.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

Waht is claimed is:

1. A down-hole drilling tool of the type for boring into the earth and supplied with a pressurized fluid flow to operate said tool for increase boring rate, said drilling tool comprising: impact piston means moved by the fluid flow toward and away from an impact position for producing an impact force; conduit network means for conducting the fluid flow to said impact piston means ; and control valve means in said conduit network means for controlling fluid flow to said impact piston means and at least a portion of said control valve means being movable between a first position for directing the fluid flow in said conduit network means to move said impact piston means toward said impact position and a second position for directing the fluid flow in said conduit network means to move said impact piston means away from said impact position, said control valve means being responsive to fluid flow in said conduit network means for continuously cycling between said first and second positions; said drilling tool characterized by said portion of said control valve means continuously cycling between said first and second positions independently of the position of said impact piston means, said conduit network means including a tap in the fluid flow to said impact piston means and pilot passage means continuously conveying pilot fluid pressure from said tap in said conduit network means to said control valve means, said control valve means being responsive to said pilot fluid pressure for continuously cycling between said first and second positions independently of the fluid flow in said conduit network means after said tap.

2. A drilling tool as set forth in claim 1 further characterized by said control valve means including a movable spool having valve land means associated with said pilot passage means (46) and responsive to said pilot fluid pressure for continuously cycling between said first and second positions depending on the position of said spool relative to said first and second positions.

3. A drilling tool as set forth in claim 2 wherein said spool is disposed within a valve chamber of said conduit network means and further characterized by said spool being reciprocated along a longitudinal axis thereof between said first and second positions within said valve chamber.

4. A drilling tool as set forth in claim 3 further characterized by said valve chamber disposed in said conduit network means after said tap.

5. A drilling tool (10) as set forth in claim 4 wherein said spool includes a top end and a bottom end further characterized by said control valve means including a core member extending axially through said valve chamber and adjacent said valve land means for conducting said pilot fluid pressure to said top and bottom ends and said valve land means.

6. A drilling tool as set forth in claim 5 further characterized by said conduit network means including a major flow passage disposed between said tap and said valve chamber for conducting fluid flow to said impact piston means.

7. A drilling tool as set forth in claim 6 further characterized by said conduit network means including a first feed passage for conducting the fluid flow from said valve chamber to move said impact piston means toward said impact position and a second feed passage for conducting fluid flow from said valve chamber to move said impact piston means away from said impact position.

8. A drilling tool as set forth in claim 7 further characterized by said spool including valve channel means for conducting the fluid flow from said major flow passage to said first feed passage when in said first position and to said second feed passage when in said second position.

9. A drilling tool as set forth in claim 8 wherein said valve chamber is defined by the internal area of a cylindrical wall in said conduit network means further characterized by said valve channel means including an upper lip in fluid sealing engagement with said valve chamber wall, an axially spaced lower lip in fluid sealing engagement with said valve chamber wall, and a central channel disposed between said upper and lower lips, said central channel in continuous communication with said major flow passage and alternating communication between said first and second feed passages as said spool reciprocates in said valve chamber.

10. A drilling tool as set forth in claim 9 further characterized by said central channel providing a continuous axial length about the periphery of said spool.

11. A drilling tool as set forth in claim 10 further characterized by said core member being substantially cylindrical and having a longitudinal axis coincidental with said longitudinal axis of said spool

12. A drillling tool as set forth in claim 11 further characterized by said spool comprising a body of revolution about said longitudinal axis.

13. A drilling tool as set forth in claim 12 further characterized by said first feed passage having an opening in communication with said valve chamber and said second feed passage having an opening in communication with said valve chamber, said opening of said first feed passage being axially spaced relative to said opening of said second feed passage.

14. A drilling tool as set forth in claim 13 further characterized by said axial space between said openings of said first and second feed passage being at least equal to said continuous axial width of said central channel.

15. A drilling tool as set forth in claim 14 further characterized by said major flow passage having an opening into said valve chamber at an axial spacing centrally of said openings of said first and second feed passages.

16. A drilling tool as set forth in claim 15 wherein said valve chamber includes a top end and a bottom end further characterized by said first feed passage opening being disposed adjacent said bottom end of said valve chamber and said second feed passage opening being disposed adjacent said top end of said valve chamber, said first position defined by said central channel of said control valve means in communication with said first feed passage and said second position defined by said central channel of said control valve means in communication with said second feed passage.

17. A drilling tool as set forth in claim 16 further characterized by said valve land means of said control valve means including an annular upper land (72), and axially spaced annular lower land, and an annular recess between said upper and lower lands and having a continuous axial length, said upper and lower lands in fluid sealing engagement with said core member.

18. A drilling tool as set forth in claim 17 further characterized by said core member including a pilot feed passage having a portion extending radially outwardly of said longitudinal axis and in continuous communication with said recess of said valve land means.

19. A drilling tool as set forth in claim 18 further characterized by said core member including at least one upper feed passage and at least one axially spaced lower feed passage, said upper and lower feed passages each including an inlet port adjacent said pilot feed passage and an axially spaced distal outlet port, the axial space between said inlet ports being at least equal to the axial length of said recess.

20. A drilling tool as set forth in claim 19 further characterized by said inlet ports of said upper and lower feed passages alternately communicating with said pilot feed passage as said control valve means reciprocates between said first and second positions.

21. A drilling tool as set forth in claim 20 further characterized by said conduit network means including vent passage means for conducting fluid out of said drilling tool.

22. A drilling tool as set forth in claim 21 further characterized by said conduit network means including a cylinder having a top end and an axially spaced anvil surface, and said impact piston means including a piston reciprocated along a longitudinal axis thereof within said cylinder toward and away from said impact position, said piston contacting said anvil surface when in said impact position.

23. A drilling tool as set forth in claim 22 further characterized by said first feed passage being in communication with said cylinder and having an exit disposed in said cylinder adjacent said top end and said second feed passage being in communication with said cylinder and having an exit disposed in said cylinder adjacent said anvil surface.

24. A down-hole drilling tool of the type for boring into the earth and supplied with a pressurized fluid flow to operate said tool for increasing boring rate, said drilling tool comprising: impact means moved by the fluid flow toward and away from an impact position for producing an impact force; conduit network means for conducting the fluid flow to said impact means; and control valve means in said conduit network means for controlling fluid flow to said impact means, at least a portion of said control valve means being movable between a first position for directing fluid flow in said conduit network means to move said impact means toward said impact position and a second position for directing the fluid flow in said conduit network means to move said impact means (12) away from said impact position, said portion of said control valve means being responsive to fluid flow in said conduit network means for continuously cycling between said first and second positions; said drilling tool characterized by said conduit network means including a tap in the fluid flow to said impact means and pilot passage means continuously conveying pilot fluid pressure from said tap in said conduit network means to said control valve means, said control valve means being responsive to said pilot fluid pressure for continuously cycling between said first and second positions independently of the fluid flow after said tap.

* * * * *